United States Patent [19]

Nakajima et al.

[11] 4,395,109

[45] Jul. 26, 1983

[54] FIXING DEVICE FOR ELECTRONIC DUPLICATOR MACHINE

[75] Inventors: Shunichi Nakajima, Yokohama; Hiroshi Odaira, Chigasaki, both of Japan

[73] Assignee: Tokyo Shibaura Denki Kabushiki Kaisha, Kawasaki, Japan

[21] Appl. No.: 156,866

[22] Filed: Jun. 5, 1980

[30] Foreign Application Priority Data

| | | | |
|---|---|---|---|
| Jun. 11, 1979 | [JP] | Japan | 54-73325 |
| Jun. 11, 1979 | [JP] | Japan | 54-73326 |
| Jun. 11, 1979 | [JP] | Japan | 54-73327 |
| Jun. 11, 1979 | [JP] | Japan | 54-73328 |
| Jun. 11, 1979 | [JP] | Japan | 54-73329 |
| Jun. 11, 1979 | [JP] | Japan | 54-73330 |
| Jun. 11, 1979 | [JP] | Japan | 54-73331 |

[51] Int. Cl.[3] ..... G03G 15/20

[52] U.S. Cl. ..... 355/3 FU; 219/216; 219/469; 219/471; 432/60

[58] Field of Search ..... 355/3 R, 3 FU, 14 FU; 432/60, 228; 219/216, 469, 470, 471

[56] References Cited

U.S. PATENT DOCUMENTS

| | | | |
|---|---|---|---|
| 2,270,321 | 1/1942 | Lott | 219/469 X |
| 3,111,081 | 11/1963 | Westbrook | 219/471 X |
| 3,243,579 | 3/1966 | Sussin | 219/469 |
| 3,401,439 | 9/1968 | Staats et al. | 219/469 X |
| 3,437,032 | 4/1969 | Manghirmalani et al. | 219/470 X |
| 3,649,810 | 3/1972 | Tsuboi et al. | 219/216 |
| 3,854,034 | 12/1974 | Leitner et al. | 219/469 X |
| 3,912,901 | 10/1975 | Strella et al. | 219/216 |
| 3,948,214 | 4/1976 | Thettu | 432/60 X |
| 3,968,347 | 7/1976 | Isoard | 219/469 X |
| 4,109,135 | 8/1978 | Minden et al. | 432/60 X |
| 4,179,601 | 12/1979 | Tarumi et al. | 219/216 |
| 4,266,115 | 5/1981 | Dannatt | 219/216 |

*Primary Examiner*—Fred L. Braun

*Attorney, Agent, or Firm*—Cushman, Darby & Cushman

[57] ABSTRACT

An electronic duplicator machine heats a toner attached to a copying paper and a fixing device fixes the toner to the paper. The fixing device includes a heat generating roller which includes a supporting body having a journal portion on either end surface and rotatably supported by the journal portion; a heat insulating layer formed on the outer circumferential surface of the supporting body to prevent the transmission of heat to the supporting body; a resistance heater layer through which a current flows to heat the toner and which covers the outer circumferential surface of the heat insulating layer.

8 Claims, 21 Drawing Figures

FIXING DEVICE FOR ELECTRONIC DUPLICATOR MACHINE

BACKGROUND OF THE INVENTION

This invention relates to a fixing device for an electronic duplicator machine and, more particularly, to a fixing device for an electronic duplicator machine which is equipped with a heat generating roller for heating non-fixed toner transferred onto a copying paper and fixing the toner onto the same.

There have recently been put to practical use a number of fixing devices, for the reasons that they have as one of their merits the capability of obtaining a stable fixed image, each of which comprises a rotary heat generating roller and a copying paper supporting means which is provided to oppose the roller and which supports the copying paper, to which non-fixed toner is to be attached, so as to permit the paper to contact the roller, whereby the non-fixed toner is heated and fixed onto the copying paper.

Conventionally, in the above-mentioned type of fixing devices such a heat generating roller (10) as shown in FIG. 1 is employed. The roller (10) comprises a roller body (14) which is rotatably supported by means of bearings or journals (12) and a tubular infrared ray heater (16) which is provided in alignment with the central axis of the roller body (14), whereby a coating (20) of, for example, silicon rubber is applied onto the outer circumferential surface of a core (18) the roller body (14) being heated by the generation of heat from the tubular infrared ray heater (16), up to a predetermined temperature.

Since, as stated above, the fixing device equipped with the heat generating roller (10) uses the tubular infrared ray heater (16) at the central axis of the roller body and thereby heats the coating (20) up to a fixable temperature, the time required until the arrival at such fixable temperature, i.e., the warming up time, is about 3 to 5 minutes as indicated by broken line (A) in FIG. 2. This warming up time is very long as compared with that required for another heat generating means (radiant means) which is about 1 to 3 minutes as indicated by a two-dot dash line (B) also in FIG. 2. This does not only irritate the operator but also results in a large loss of heat thereby causing an increase in the power consumption.

SUMMARY OF THE INVENTION

Accordingly, the object of the present invention is to provide a fixing device for an electronic duplicator machine which is capable of shortening the above-mentioned warming up time by improving the heat generating roller incorporated therein.

According to an aspect of the present invention, there is provided a fixing device for an electronic duplicator machine, intended to heat a toner attached to a copying paper and fix it to the same, which comprises: a heat generating roller which includes a supporting body having a journal portion at either end and rotatably supported by the journal portion; a heat insulating layer formed on the outer circumferential surface of the supporting body to prevent the transmission of heat to the supporting body; and a heat generating means formed in the shape of a film in a manner to cover the outer circumferential surface of the heat insulating layer to heat the toner.

DETAILED DESCRIPTION OF THE PREFERRED EMBODIMENTS

Reference will now be made to a fixing device for an electronic duplicator machine according to one embodiment of the invention in connection with FIGS. 3 to 12 of the appended drawings.

Figure 1:
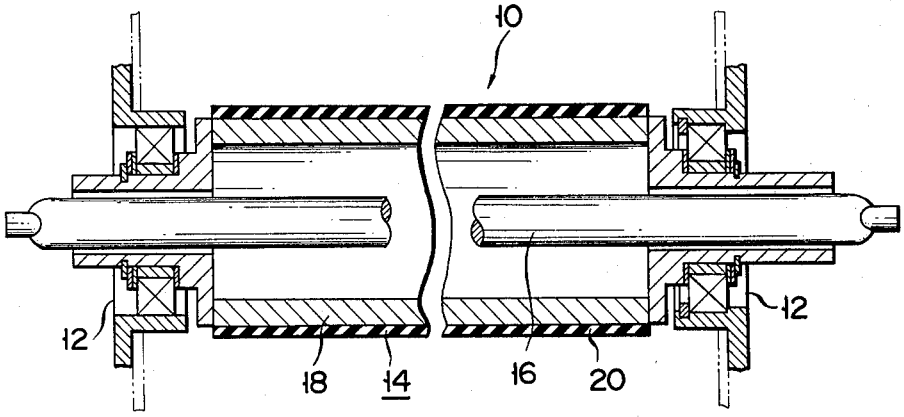
FIG. 1 PRIOR ART
FIG. 1 is a front view, in longitudinal section, of the construction of a conventional heat generating roller.
Figure 2:
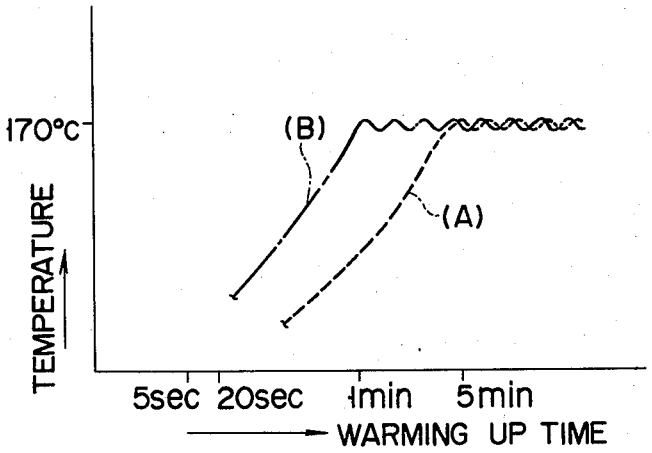
FIG. 2 PRIOR ART
FIG. 2 is a linear diagram showing the warming up time of the conventional heat generating roller.
Figure 3:
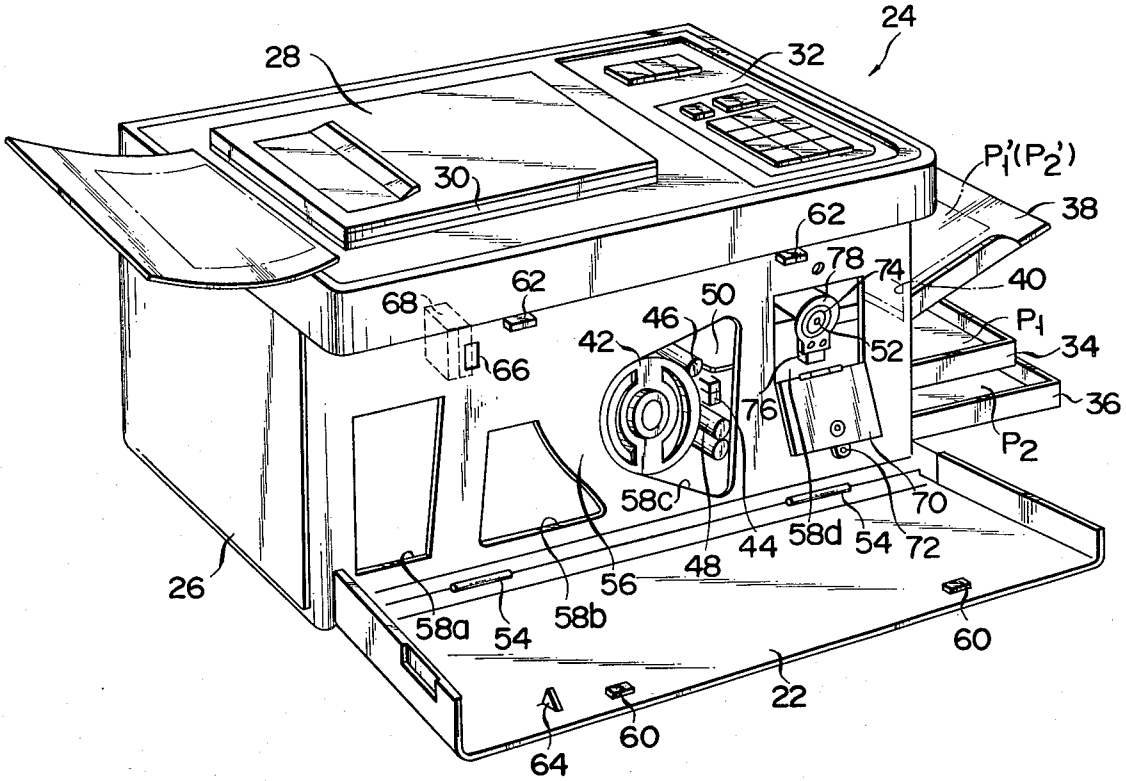
FIG. 3 is a schematic perspective view, with the front cover opened, of an electronic duplicator machine equipped with a fixing device according to one embodiment of the invention.

FIG. 3 shows an electronic duplicator machine (24) with its front cover (22) opened, which has a main body (26). On the upper surface of the main body (26) are disposed at specified positions an original mounting bed (30) having an original keeping cover (28) and a control panel (32), respectively. On one side of the main body (26) are provided a pair of paper feed cassettes (34) and (36) for respectively receiving different sizes of copying papers $P_1$ and $P_2$ and a paper discharge tray (38), said paired cassettes (34) and (36) and the tray (38) being attached via paper feed openings (not shown) and a paper discharge opening (40) formed on that one side of the main body (26).

A photo-sensitive material coated drum (42) is rotatably provided substantially at the central part of the main body (26). At specified positions around the outer circumference of the photo-sensitive material coated drum (42) along the rotating direction of the drum (42) are disposed an electric charge device (not shown), a projecting section (not shown) of a light exposure device (not shown), a developing device (not shown), a transfer device (44), a peeling device (46), an electricity removing device (not shown) and a cleaning device (not shown), in turn, in the sequential order mentioned. On one of the sides of the main body (26) adjoining to said one side thereof are provided a copying paper feed path (48) for guiding the copying paper $P_1$ or $P_2$ selectively drawn out from either one of the pair of paper feed cassettes (34) and (36) and a copying paper discharge path (50) for guiding to the paper discharge tray (38) the copying paper $P_1$ or $P_2$ which has been peeled off by the peeling device (46) after the transfer operation.

In the mid course of the copying paper discharge path (50) there is disposed a toner fixing device (52) as later described which serves to fix to the paper $P_1$ or $P_2$ the toner transferred and attached but not fixed to the paper $P_1$ or $P_2$.

Within the main body and on the other of said adjoining sides of the main body (26) are received a motor as a drive source, a high voltage transformer, and a blower (none of them is shown).

The front cover (22) is attached to the main body (26) via a pair of hinges (54) so as to be free of the opening/-closing operation. As shown, the front cover (22) is so arranged that when it is opened, a frame (56) of the front side is exposed, the frame being formed with a plurality of windows (58*a*) to (58*d*) for the purpose of inspecting and adjusting the internal mechanisms of the main body (26). On the inner surface of the free end portion of the front cover (22) are provided a pair of iron pieces (60) and in corresponding relationship thereto a pair of magnet catches (62) are provided on the frame (56) of the front side of the main body (26). The pieces (60) are caught by the catches (62) when the front cover (22) is closed. Accordingly, the front cover (22), when closed, is stably held in closed position by the direct connection of the iron pieces (60) to the magnet catches (62).

A plate projection (64) is provided on a portion of the front cover (22) in the proximity of one of the paired iron pieces (60). A bore (66) for receiving the plate projection (64) is formed in the front frame (56) of the main body (26) at the position which corresponds to the plate projection (64) when the front cover (22) is closed. Within the bore (66) is disposed a cover switch (68) which makes the on-off control of the power supply to the fixing device (52). When the front cover (22) is closed, the cover switch (68) is made "on" by the plate projection (64) to permit the supply of power to the fixing device (52). On the other hand, when the front cover (22) is opened, the cover switch (68) is made "off" by disengagement of the plate projection (64) from the bore (66) to check the supply of power to the fixing device (52).

Covering window (58*d*) which is formed in the front frame (56) and which opposes the fixing device (52) there is provided a safety covering (70) to prevent finger insertion and to concurrently serve as a heat insulation plate. This safety covering (70) is hinged to the front frame (56) so as to be opened on demand. Namely, the fixing device (52) is arranged so as to be unexposed with the front cover (22) opened. On the free end portion of the safety covering (70) there is provided a knob (72) which is formed so as to function as a retainer for retaining the safety covering (70) in the closed state.

In the electronic duplicator machine (24) having the above-mentioned construction, an original paper is set on the original mounting bed (30) with the safety covering (70) and front cover (22) being both closed. Thereafter, the switch disposed on the control panel (32) is actuated, whereby a duplicating signal is generated to start the copying operation. In response to a duplicating signal from the control panel (32) the photo-sensitive drum (42) starts to rotate and the associated devices disposed around the drum (42) are also caused to operate. Thus, the same toner image as that on the original is formed on the surface of the drum (42). On the other hand, in synchronization with such toner image forming operation a single sheet of copying paper $P_1$ or $P_2$ fed onto the surface of the rotating drum (42) and the toner image is transferred by the transfer device (44) onto the paper sheet $P_1$ or $P_2$. The paper $P_1$ or $P_2$ onto which the toner image is transferred is peeled off by the peeling device (46) from the rotating drum (42) and then is transported to the copying paper discharge path (50). At this point, the toner image as transferred from the original still remains to be fixed. The toner image is fixed by the fixing device (52) onto the paper sheet $P_1$ or $P_2$. The paper sheet $P_1'$ or $P_2'$ thus fixed is discharged onto the discharge tray (38) via the paper discharge opening (40).

Figure 4:
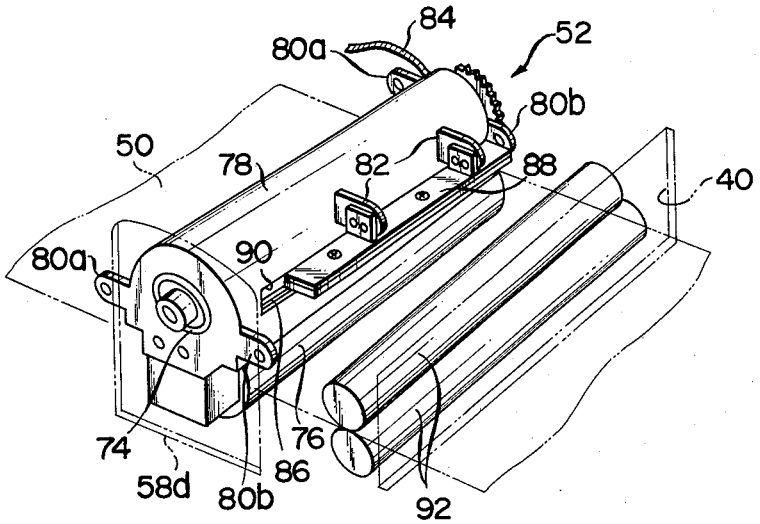
FIG. 4 is a perspective view, in a separated form, of the fixing device according to one embodiment of the invention.
Figure 5:
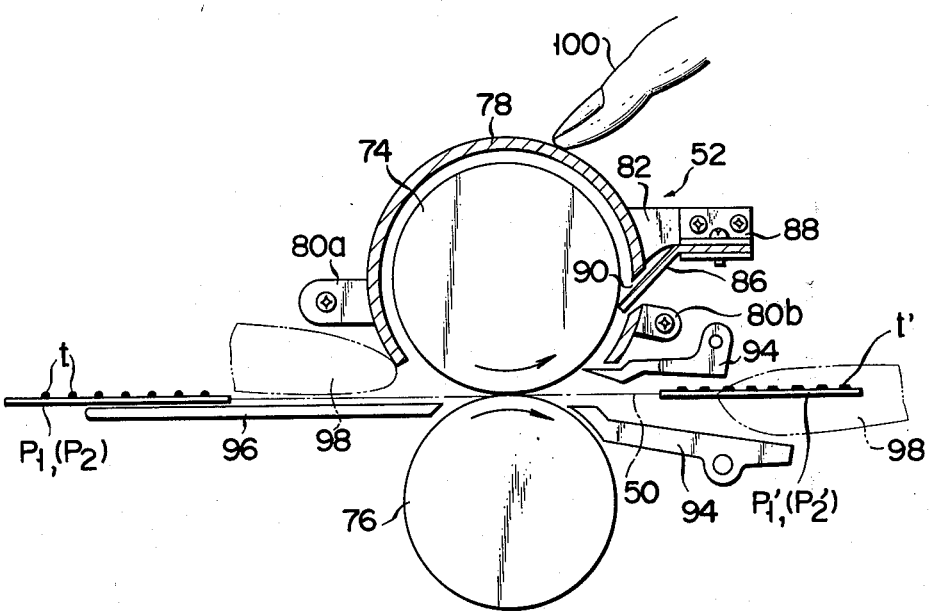
FIG. 5 is a schematic side view, in cross section, of the fixing device shown in FIG. 4.

The fixing device (52), as shown in FIGS. 4 and 5, comprises a heat generating roller (74) as later discribed in detail which is rotatably provided in a manner such that it is located on the upside of the copying paper discharge path (50), and a movable roller (76) paired with the heat generating roller (74) which is located on the underside of the copying paper discharge path (50) and beneath the heat generating roller (74) and which serves as a paper sheet support means for supporting the paper $P_1$ or $P_2$ bearing the non-fixed toner so as to permit that paper to contact the heat generating roller (74). Thus, the fixing device heats the non-fixed toner and fixes it to the paper sheet $P_1$ or $P_2$.

Around the outer circumferential surface of the heat generating roller (74) there is provided a covering (78) for preventing finger touch upon the roller (74) at a specified interval of, for example, about 3 mm from the same. The finger touch preventive covering (78) functions to prevent the operator's finger or fingers from directly touching the heat generating roller (74) even if the operator inserts his finger into the main body 26 from the windows (58*c*) and (58*d*) corresponding to the photo-sensitive drum (42) and the fixing device (52). On each end of the preventive covering (78) are provided a pair of attaching pieces (80*a*) and (80*b*), said ends being fixed to the front side frame (56) and a rear side frame (84) via the attaching piece pairs, respectively. At specified positions of the outer circumference of the preventive covering (78) there are projectively provided thereon a pair of axially spaced stays (82) which are fitted with a cleaning blade (86) via a blade holder (88). Further, a slit (90) is formed in the outer circumference of the preventive covering (78) at a specifically position thereof and in the longitudinal direction thereof. The cleaning blade (86) extends into the interior of the preventive covering (98) through the slit (90) and is brought into forced contact with the outer circumferential surface of the heat generating roller (74). The cleaning blade (86) exfoliates the toner offset on the heat generating roller (74) to always keep the outer circumference thereof clean.

As shown in FIG. 4, a pair of paper discharge rollers (92) kept in contact with each other are disposed in the copying paper discharge path (50) in the vicinity of the copying paper discharge opening (40). These rollers (92) also function as an operator's finger insertion preventive means for preventing the insertion of the operator's finger through the paper discharge opening (40). Further, as shown in FIG. 5, in the copying paper discharge path (50) on the side thereof from which the non-fixed paper $P_1$ or $P_2$ is carried onto the path (50) there is provided a guide plate (96) for guiding that paper $P_1$ or $P_2$ into the nip portion of the paired rollers (74) and (76) along the copying paper discharge path (50). A pair of scrapers (94) has its tip ends allowed to abut upon the outer circumferential surfaces of the paired rollers (74) and (76), respectively, which are disposed on the copying paper discharge path (50) on the side thereof from which the fixed copying paper $P_1'$ or $P_2'$ is fed out. This scraper (94) has the function to scrape the fixed copying paper $P_1'$ or $P_2'$ which has been cohered to either one of the heat generating roller (74) and its roller (76) paired therewith.

Note here that numeral (98) in FIG. 5 denotes a test rod on the safety standard as modelled from a human finger (100), and that this rod is intended to test whether or not the operator's finger may touch the heat generating roller (74) in cases where he tries to forcibly insert his finger along the copying paper discharge path (50). Note also that the alphabetic letter t in FIG. 5 denotes a portion of non-fixed toner and t' a portion of fixed toner.

Figure 6:
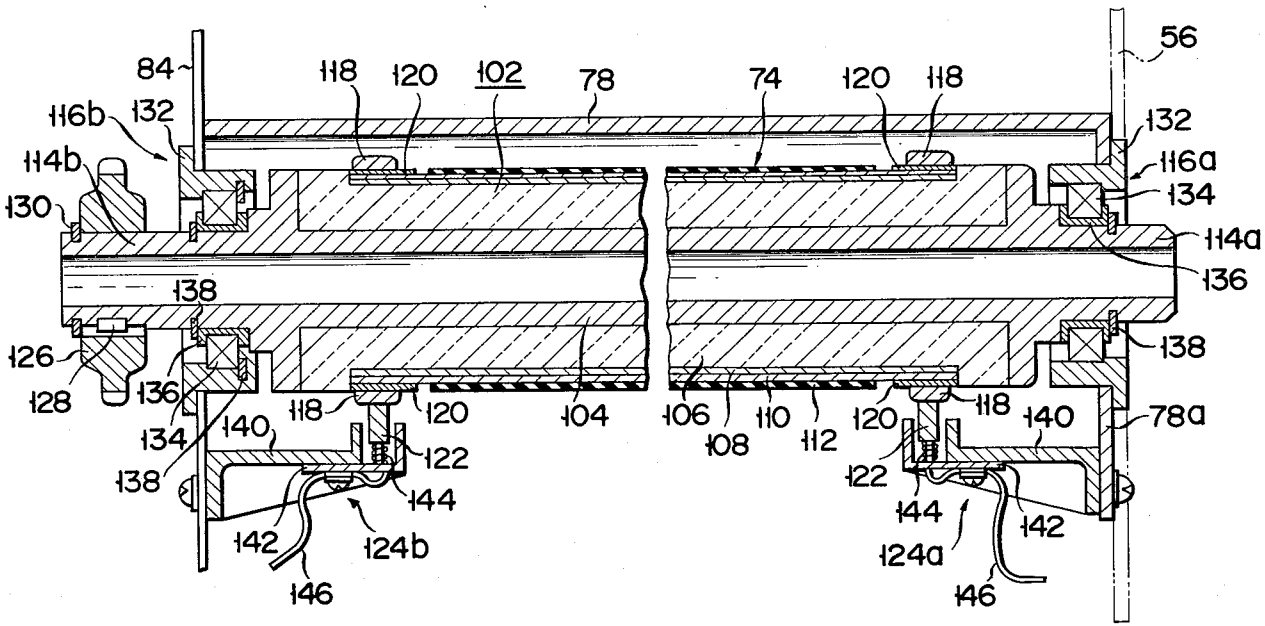
FIG. 6 is a front view, in longitudinal section, of a heat generating roller.
Figure 7:
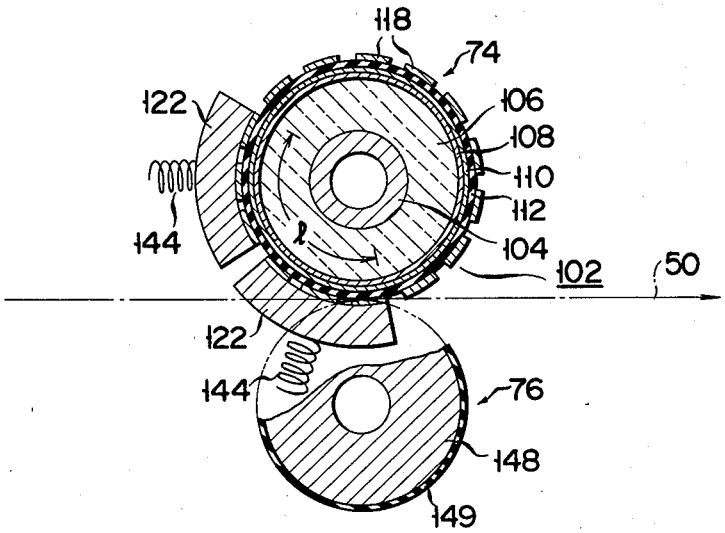
FIG. 7 is a cross sectional view showing the heat generating roller and a roller paired with the heat generating roller.
Figure 8:
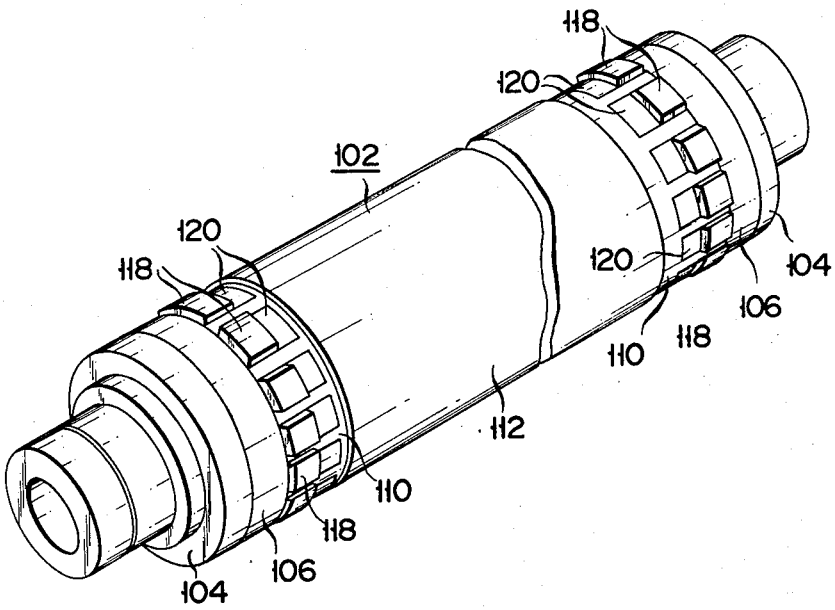
FIG. 8 is a perspective view of the heat generating roller shown in FIG. 6.

The heat generating roller (74), as shown in FIGS. 6 to 8, comprises a roller body (102), a pair of journal means (116*a*) and (116*b*) for rotatably supporting the roller body (102), and power supply sections (124*a*), (124*b*) for supply of the power to the roller body (102). The roller body (102) comprises a core body (104), serving as a supporter of the roller body (102), which consists of metal, ceramic or other materials having mechanical strength. The roller body (102) further comprises a heat insulating layer (106), an electrically insulating layer (108), a resistance heater layer (110) as later described and a protective layer (112), each of which is radially formed on the outer circumference of the core body (104) in the order mentioned. The core body (104) is coaxially provided, at each of its ends, with shaft portions (114*a*), (114*b*) which are movably supported by their corresponding journal means (116*a*), (116*b*), respectively. Each of the shaft portions (114*a*), (114*b*) are not always required to be smaller in diameter than the heat generating portion. They may have much the same diameter as the heat generating portion. Further, the journal portion may be a three-ball bearing on each side to hold the shaft in place by rolling contact. The point is that only if the shaft is held in a specified position by such journal portion, this journal may be of any type.

The protective layer (112) covers a specified portion of the resistance heater layer (110) other than the end portions thereof, i.e., cover the layer (110) over a range sufficient to permit the copying paper $P_1$ or $P_2$ of maximum size used to fully contact the surface of the layer (110). The resistance heater layer (110) itself is exposed at each of its end portions. As shown in FIG. 6, a plurality of conductive elements (118) made of copper are disposed on the outer circumferential surface of the end portions of the resistance heater layer (110). Where the resistance heater layer (110) is formed of a specified base material, the conductive members (118) can be so provided as to oppose each other from the upside surface and backside surface of one end portion of the resistance heater layer (110). Each conductive element (118), in order to obtain a good bondage with the resistance heater layer (110) in a conducting relationship to the same, is fitted to the same via a highly bondable conductor (120) and is thus electrically rendered conductive with respect to the layer (110).

Power supply sections (124*a*), (124*b*) are provided for both ends of such resistance heater layer (110) and in the vicinity of the nip portion thereof. The power supply sections (124*a*), (124*b*) comprise respectively a pair of brackets (140) which consist respectively of insulating members and which are screwed to the rear frame (84) or an end face (78*a*) at the front side of the preventive covering (78), a plurality of sliding terminals (122) provided with each bracket (140) and always kept in sliding contact with the conductive elements (118) over substantially one third of the entire outer circumferential surface of the resistance heater layer (110), retaining members (142) each for retaining the sliding terminal (122) in cooperation with the corresponding bracket (140), springs (144) each for urging the sliding terminal (122) so as to press it against the conductive element (118) of the roller body (102) under a specified pressure, and lead lines each for connecting the sliding terminal (122) to a power source (not shown). This power source has a control section for supplying a specified amount of power, with a specified timing, to the heat generating roller (74). A specified level of current is allowed to pass through a portion of the resistance heater layer (110) existing between both said conductive element (118) groups at both ends thereof with which the sliding terminals (122) are kept in sliding contact. Therefore, the said portion of the resistance heater layer (110) between the conductive element (118) groups to which said current has been applied, as shown in FIG. 7, generates heat by its own length, i.e., over its conductive range l of heat generation. That is, the heat generating roller (74) is constructed so as to permit heat to be generated only from the portion of the resistance heater layer (110) which is equal in length to substantially one third of the entire outer circumferential surface of the resistance heater layer (110) including the said nip portion.

To the shaft portion (114*b*) at the rear side of the core body (104) there is secured a driven gear (126) via a key (128) and a snap ring (130). Similarly, a shaft portion, at the rear side, of the movable roller (76) is secured to a driven gear (not shown). Intermeshed with the driven gear (126) of the core body (104) is a driving gear (not shown) which is allowed to rotate in response to the output from a drive source (not shown). This driving gear is connected via an intermediate gear (not shown)

to a driven gear (not shown) of the movable roller (76). Said two driven gears are arranged to be rotated, by the rotation of the driving gear, at the same speed and in mutually opposite directions.

The portion (116*a*), at the front side, of the journal means supporting the roller body (102) is held in place by the end face (78*a*), at the front side, of the finger touch preventive covering (78) fixed to the front frame (56). The portion (116*b*), at the rear side, of said journal means is similarly held in place by the rear frame (84). Each of the journal means (116*a*), (116*b*) comprises a housing (132), a set of bearings (134) held in place by the inner circumferential surface of the housing (132), and a heating insulating ring (136) interposed between the inner circumferential surface of the bearing set (134) and the outer circumferential surface of the journal means. Note here that in FIG. 6 reference numeral (138) denotes a snap ring for keeping the bearing set (134) in a specified position.

The above-mentioned movable roller (76) brought into rolling contact with the heat generating roller (74) and designed to rotate in synchronization with the latter comprises a core body (148) and a film layer (149) formed on the outer circumferential surface of the core body (148) and made of silicon rubber having the high capability of exfoliating therefrom the copying paper $P_1'$ or $P_2'$.

Explanation will now be made of the layers (106), (108), (110) and (112) formed on the body (102) of the heat generating roller (74).

The heat insulating layer (106) is formed by using as a main component agent a powder of minute and hollow particles, e.g., a foamable base material including glass balloon, carbon balloon and silastic balloon, and using as a binder the materials listed in Table 1. The heat insulating layer (106) is coated on the outer circumferential surface of the core body (104) by roller transfer, spray coating, powder coating or other suitable coating means. One of the coating means which is to be employed in said coating process is selectively determined according to whether or not a solvent corresponding to the binder material used is necessary.

The thickness of the heat insulating layer (106), practically ranges from approximately 100 μm to 20 mm. Where the thickness of the heat insulating layer (106) is more than 20 mm, the adiabatic effect thereof ceases to indicate a substantial change. Where said thickness if less than 100 μm, the adiabatic effect of the heat insulating layer substantially vanishes. The particle size of the balloon, preferably ranges from approximately 10 μm to 100 μm. Where said particle size is less than 10 μm, the space which is created in the interior of the balloon becomes small with a result that the adiabatic effect of the heat insulating layer becomes weak. Where said particle size is more than 100 μm, it becomes difficult to make the thickness of the heat insulating layer (106) small or thin.

Figure 9:
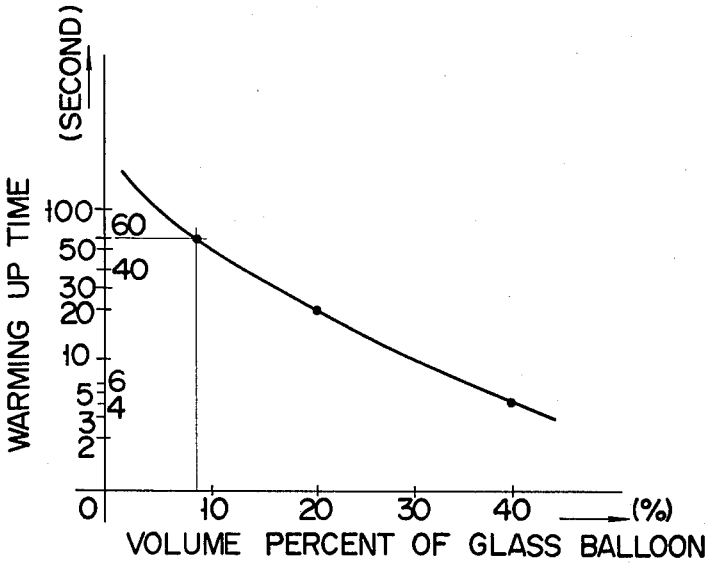
FIG. 9 is a linear diagram showing the relationship between the volume percent of a glass balloon to a binder and the warming up time concerned.

In this embodiment, the heat insulating layer (106) uses glass balloon as the main component agent and polyimide resin as the binder and has its thickness set at 2 mm. In FIG. 9, the experimental data as to the relationship between the composition of the heat insulating layer (106) and the warming up time. The construction of other constituent elements than the heat insulating layer is as mentioned in other embodiments which are described later. The data indicates that where the volumetric ratio of the glass balloon to the binder is 20:80 (the proportion of the glass balloon is 20% by volume) only a time period of 20 seconds is required, in case of the voltage applied of 100 V, until the arrival of the temperature of the generated heat at 170° C. Further, where the proportion of the glass balloon is 40% by volume, only a time period of 6 seconds is required for the same purpose.

TABLE 1

| No. | Binder | Solvent |
|---|---|---|
| 1 | Polyimide resin | Dimethyl formamide, N—methyl pyrrolidone |
| 2 | Polyamide imide resin | Dimethyl formamide, N—methyl pyrrolidone |
| 3 | Ethylene tetrafluoride resin | No counterpart solvent |
| 4 | Silicon resin | Toluene, Xylene (Hydrocarbon series) |
| 5 | Ethylene tetrafluoride/ Propylene hexafluoride resin | No counterpart solvent |
| 6 | Polythenylene sulfide resin | No counterpart solvent |
| 7 | Polysulfon resin | Cyclohexanone (Ketone series) |
| 8 | Epoxy resin | Butyl cellosolve, Cyclohexanone |
| 9 | Urethane resin | Methyl ethyl ketone, Methyl isobutyl ketone |
| 10 | Polyester resin | n.butyl carbitol acetate |
| 11 | Vinylidene fluoride | Tetrahydrofuran |

The electrically insulating layer (108) is formed of, for example, the material selected from Table 1. The electrically insulating layer (108) has the function to shape the surface of the heat insulating layer (106) as well. In this embodiment, the electrically insulating layer (108) is formed of polyimide resin and the thickness thereof is set at 10 μm.

The resistance heater layer (110) is formed of the electric resistance composition prepared by the mixing of the powdered mass of one material, for example, in Table 2 as the conductive material, with one material in Table 1 as the binder. Where the resistance heater layer (110) uses one of the compounds Nos. 1 to 9 in Table 2 as the conductive material, it is obtained by coating that one compound onto the outer circumferential surface of the electrically insulating layer (108) by means of the coating means as later described in detail. Where the resistance heater layer (110) uses one of the compound Nos. 11 to 24 in Table 2 as the conductive material, it can be obtained by any one of the means including the ion-plating, spatter, electroless plating and vacuum deposition as later described in detail.

The thickness of the resistance heater layer (110) preferably ranges from 0.1 μm to 100 μm. Where said thickness is less than 0.1 μm, the resultant layer is likely to break due to the unavoidable oxidation by air and thus decreases in the reliability. Where said thickness is more than 100 μm, the heat capacitance of the heater layer itself becomes large, so that the warming up time becomes longer than adequately required.

In this embodiment, the electric resistance composition constituting the resistance heater layer (110) uses a mixture of 50% by weight of polyimide resin, 25% by weight of carbon black (having a particle size of 0.05 μm) and 25% by weight of graphite (having a particle size of 10 μm). Further, in this embodiment, the thickness of the layer (110) is set at 40 μm.

TABLE 2

| No. | The Name of Conductive Agent | No. | The Name of Conductive Agent |
|---|---|---|---|
| 1 | Graphite | 11 | Gold |

TABLE 2-continued

| No. | The Name of Conductive Agent | No. | The Name of Conductive Agent |
|---|---|---|---|
| 2 | Carbon black | 12 | Silver |
| 3 | Lead dioxide | 13 | Platinum |
| 4 | Carborundum | 14 | Palladium |
| 5 | Ruthenium dioxide | 15 | Tantalum |
| 6 | Vanadium pentoxide | 16 | Copper |
| 7 | Barium-titanate series semiconductor | 17 | Tungsten |
| 8 | Iron trioxide | 18 | Molybdenum |
| 9 | Stannous sulfide | 19 | Nickel-chrome alloy |
| | | 20 | Nickel-phosphorus alloy |
| | | 21 | Chrome |
| | | 22 | Nickel-cobalt alloy |
| | | 23 | Chrome-silicon alloy |
| | | 24 | Chrome-titanium alloy |
| | | 24 | Titanium nitride |

Figure 10:
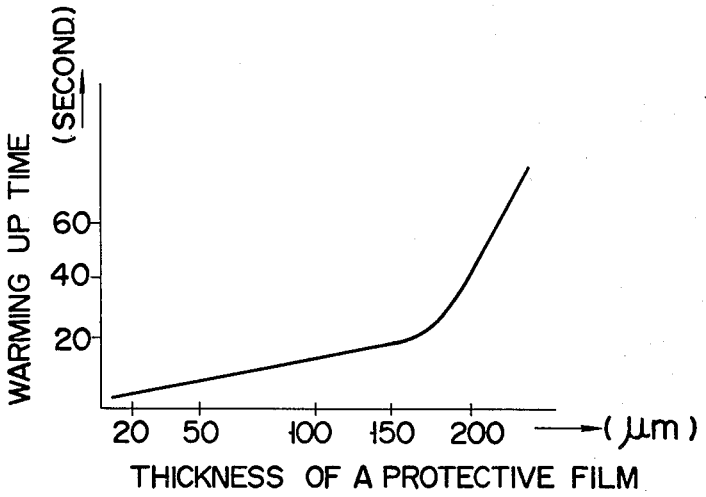
FIG. 10 is a linear diagram showing the relationship between the thickness of a protective film and the warming up time concerned.

The protective layer (112) can be formed by using the material shown in Table 1. Among such materials, ethylene tetrafluoride or silicon resin in particular is suitable that purpose from the viewpoint of electrically insulating property and exfoliation from the copying paper. Suitably, the layer (112) is chosen to have a thickness of 20 μm to 150 μm. Where the thickness of the layer (112) is less than 20 μm, the current flowing through the resistance heater layer (110) is not effectively insulated with respect to the protective layer (112) and the portion or portions contacting with the same. Further, where the thickness of the layer (112) is more than 150 μm, the layer (112) itself comes to have too large a heat capacitance with a result that as shown in FIG. 10 the warming up time fails to be shortened. In this embodiment, the layer (112) has a thickness of 40 μm.

Figure 11:
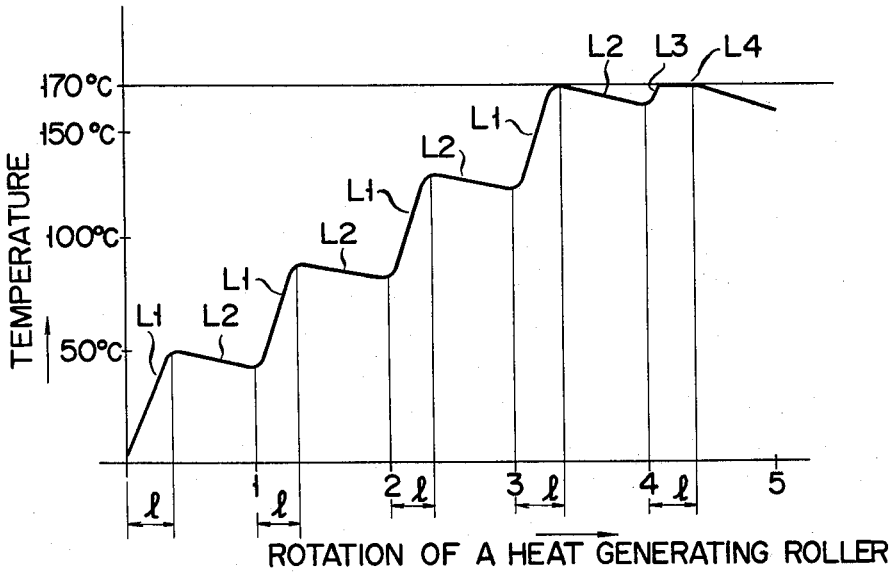
FIG. 11 is a linear diagram showing the relationship between the rotation of the heat generating roller at one point thereof and the temperature elevation.

FIG. 11 is a linear diagram showing the relationship between the rotation of the heat generating roller (102) at one point thereon and the temperature elevation. Note here that in this embodiment the diameter of the heat generating roller (74) is set at 60 mm, the discharge speed of the copying paper $P_1$ or $P_2$ set at 90 mm/sec., and the necessary temperature for toner fixation set at 170° C. As apparent from the diagram in FIG. 11, a temperature-elevated linear portion indicated at $L_1$ which corresponds to the said one point of the resistance heater layer (110) is obtained when said point of the layer (110) is located falling within the angular conducting range l of heat generation of the roller (74). When said point is located falling outside said angular conducting range l, in other words, when the conductive elements (118*a*), (118*b*) of the resistance heater layer (110) including said one point in said range of l are located at a position in which they are disconnected from the sliding terminal (122), a temperature-fall linear portion indicated at $L_2$ which corresponds to said one point falling outside said range l is obtained. After three rotations of the heat generating roller (74), i.e., after the lapse of about one second in terms of time length, the surface temperature of the resistance heater layer (110) increases up to about 170° C. Thereafter, the linear diagram, as indicated at $L_3$ and $L_4$, becomes substantially horizontal along the line of temperature of 170° C., thus the said surface temperature becomes stable. Since the said conductive range of heat generation is about ⅓ of the entire outer circumferential surface of the resistance heater layer (110), the power consumption is only about ⅓ of that which is required for the heat generation of the whole of such outer circumferential surface.

Figure 12:
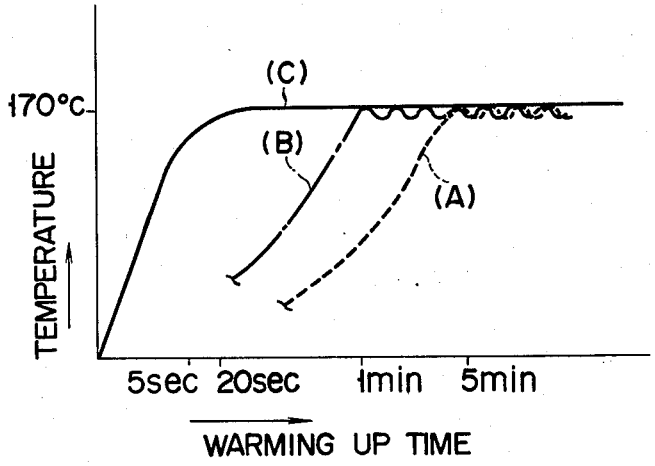
FIG. 12 is a linear diagram showing the relationship between the warming up time of the prior art and of the invention, and the temperature.

FIG. 12 is a linear diagram showing the time period which is required for the warming up action. The warming up time required for the fixing device (52) as has been above stated in detail, as indicated in a solid line C, is as extremely short as approximately 0.2 to 5 seconds.

If use is made of the fixing device according to the above embodiment, the resultant warming up time can be largely shortened as compared with the warming up time of 3 to 5 minutes which is required, as indicated in a broken line A, for the said conventional fixing device equipped with a tubular infrared rays heater and also as compared with the warming up time of about 1 to 3 minutes which is required, as indicated in a two-dot dash line B, for the fixing device of conventional radiant system.

Further, according to the above embodiment, the toner fixing device is only formed, on its support body, with the heat insulating layer, resistance heater layer, and protective film layer in the order mentioned and further is not required to be equipped with a temperature control device, surface temperature detector, etc., so that the device construction is simplified. Further, since according to the above embodiment no use was made of the conventional expensive tubular infrared rays heater, the cost reduction can be achieved and the device has high reliability with respect to troubles. Further, by determining the amount of current passing through the resistance heater layer a desired level of temperature is reached even if the power is not subjected to on/off operation. For this reason, it is very easy to control the temperature of the resistance heating layer and thus a large temperature discrepancy does not occur between local portions which is attributed to the difference in the size of paper sheet. Further, since according to the above embodiment the device has the heat insulating layer, the heat of the resistance heater layer can be prevented from being transmitted to the support body of the device and further the heat capacitance of the resistance heater layer makes the warming up time as extremely short as about 0.2 to 5 seconds. Furthermore, the heat loss is small so as to permit power consumption reduction. Further, since the copying paper is contacted with the resistance heater layer via the protective film layer only, the toner fixing device has a good fixing efficiency.

Since according to the above embodiment the thickness of the resistance heater layer is set at a value of 0.1 μm to 100 μm, this layer has a small heat capacitance and yet generates a necessary amount of heat and further is suitable for mass-production.

Further, since in the above embodiment the thickness of the protective film layer was set at a value of 20 μm to 150 μm, this layer has a small heat capacitance and is sufficient to electrically insulate.

Further, since according to the above embodiment the heat insulating layer was molded from the foamable base material, it is low in cost, light in weight and low in heat transmission efficiency. It is easy to form and has a surface having an affinity with the adjoining thin film layer or layers, for the same reason.

Further, since according to the above embodiment the sliding terminal is so positioned that the portion of the resistance heater layer with which the non-fixed copying paper is contacted falls at all times under the conducting range l of heat generation, a sufficient and stable level of temperature is maintained, with small power consumption, with respect to the device parts associated with the fixing action.

In the above-mentioned embodiment, the conductive elements (118) are disposed on both end portions of the resistance heater layer (110), in the circumferential direction thereof and at equal intervals, and the conducting range l of heat generation is set only to part of the circumference of the layer (110) including the said nip portion. The present invention, however, is not limited to such construction. If the conductive elements, are disposed over the entire circumference of the layer (110) and in the form of no-terminal or in the endless form and the resistance heater layer is formed of the material having the PTC (Positive Temperature Coefficient) characteristic, the same effect as that otherwise obtainable can be obtained.

Reference will now be made to another embodiment in connection with FIGS. 13 to 16 of the accompanying drawings. Note that like members or elements or parts are denoted by like reference numerals and description of those is omitted.

Figure 13:
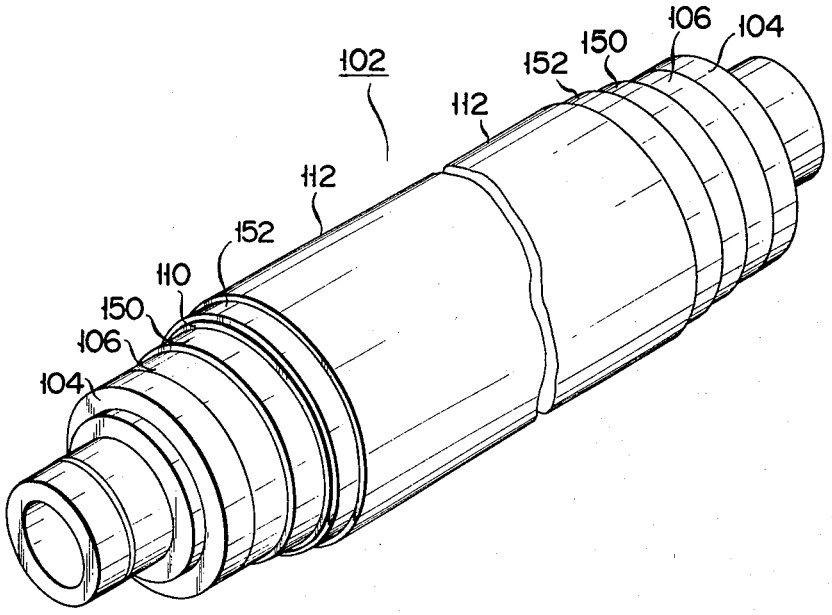
FIG. 13 is a perspective view of the heat generating roller according to another embodiment of the invention.
Figure 14:
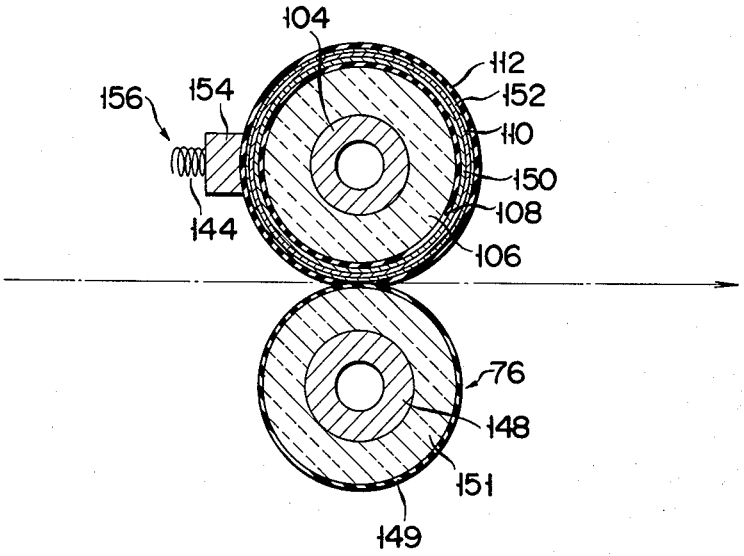
FIG. 14 is a cross sectional view showing the heat generating roller shown in FIG. 13 and a roller paired with the heat generating roller.
Figure 15:
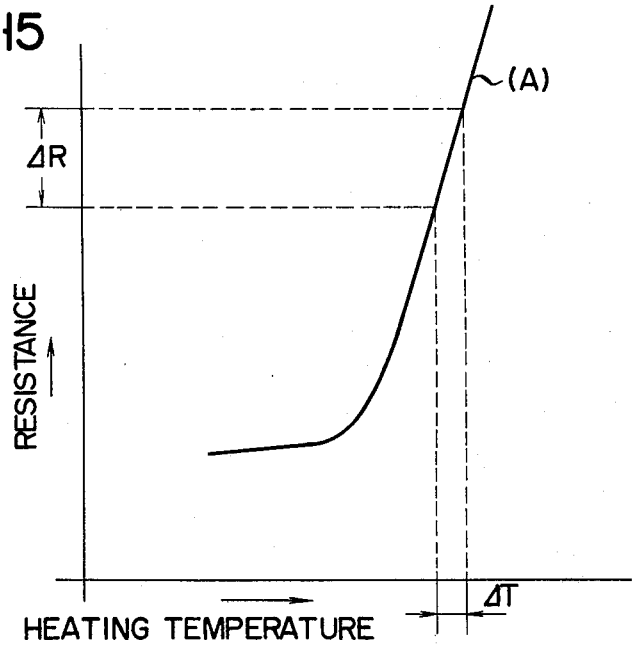
FIG. 15 is a linear diagram showing the PTC characteristics.

As shown in FIGS. 13 and 14, on the outer and inner circumferential surfaces of the resistance heater layer (110) are provided conductive layers (150), (152) made of copper so as to permit current to pass through the resistance heater layer (110). Both end portions of the outer circumference of each conductive layer (150) or (152) are exposed to outside and there are provided a pair of power supply sections (156) having sliding terminals (154) kept respectively in sliding contact with the conductive layers (150), (152). Accordingly, when current is passed through the layer (110) from the power supply sections (156), the resistance heater layer (110) generates heat from their respective whole body. Where the resistance heater layer is formed of the material having the PTC characteristic as later described, it is possible to provide a power supply section only on either one end of the roller and cause it to supply a power to the resistance heater layer (110) from both of the outer and inner circumferences thereof.

The resistance heater layer (110) is formed of the material having the above-mentioned PTC characteristic. This PTC characteristic is that as indicated in a solid line (A) in FIG. 15 the change $\Delta R$ in electric resistance is positive with respect to the change $\Delta T$ in temperature and yet is very wide. Known as the resistance heater material having such PTC characteristic are barium-titanate series semiconductor, etc. In this embodiment ethylene tetrafluoride is used as the material having the PTC characteristics and the resistance heater layer is prepared by mixing 60% by weight of ethylene tetrafluoride powder (having an average particle size of 5 $\mu$m) with 40% by weight of conductive carbon black powder (having an average particle size of 0.05 $\mu$m). The layer (110) is coated, on its inner surface, with the conductive resin containing Ag powder having a thickness of 3 $\mu$m and is deposited, on its outer surface, with Al to permit the deposited thickness of Al to become 5 $\mu$. The thickness of the resistance heater layer (110) itself is set to 30 $\mu$m, whereby to obtain a surface temperature of 170° C. Note here that barium titanate semiconductor can also be used as the material having the PTC characteristic.

With the toner fixing device (52) having the foregoing construction, it has been confirmed that the warming up time can be reduced to as extremely short a period as 0.2 to 5 seconds.

Figure 16:
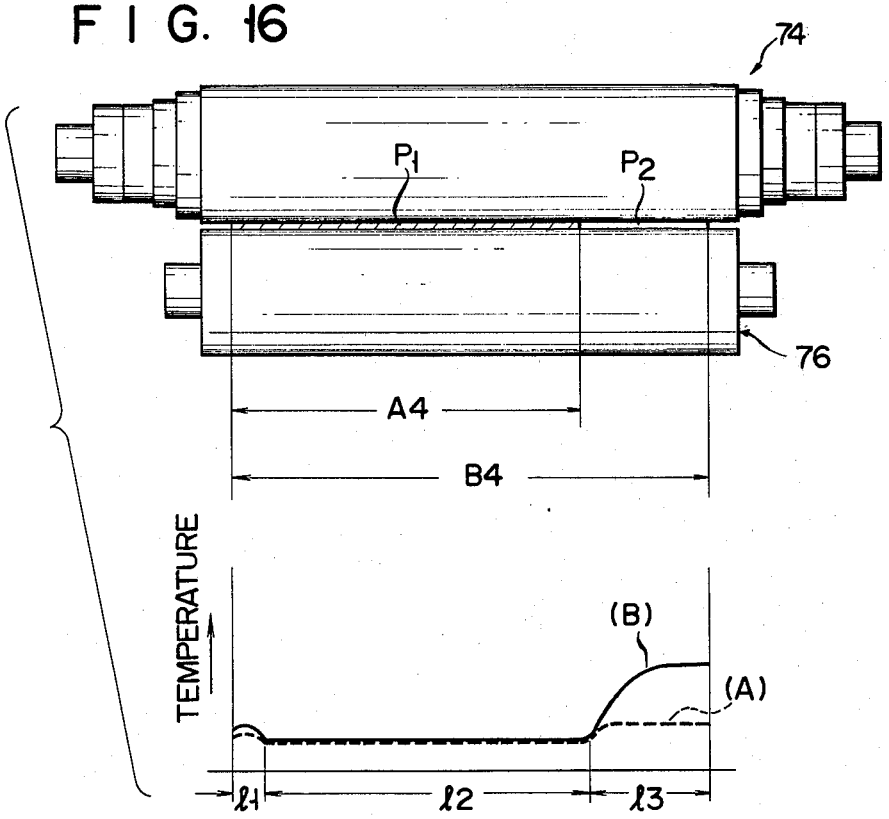
FIG. 16 is a view showing the relationship between each size of paper and the surface temperature distribution of the heat generating roller.

As shown in FIG. 16, the copying paper $P_1$ or $P_2$ is allowed to pass between the heat generating roller (74) and the roller (76) paired therewith. Where the copying paper $P_1$ is of the A4 size (210 mm×297 mm) and the copying paper $P_2$ of the B4 size (257 mm×364 mm), when the smaller size of copying paper $P_1$ is passed between the rollers (74) and (76), the temperature distribution of the surface of the heat generating roller (74) is as illustrated in the linear diagram which is given below FIG. 16. That is to say, since the roller portion $l_2$ which the copying paper $P_1$ is passed through is deprived of its heat by the paper $P_1$, the surface temperature of the roller is likely to be lowered thereby. The power, therefore, which is necessary to compensate for such temperature fall is supplied to the roller. As a result, the roller portion $l_3$ which corresponds to the difference in size between the copying paper $P_1$ and the copying paper $P_2$ larger in size than the $P_1$, as shown in a solid line (B), is likely to have a temperature higher than that as initially set. Since, however, the resistance heater layer has the PTC characteristic, the local elevation of temperature due to the difference in respect of the paper size is automatically corrected as shown in a broken line (A) in the linear diagram portion of FIG. 16. As a result, the resistance heater layer can prevent a large difference in temperature between local roller portions from being produced unlike the temperature distribution obtainable by the resistance heater layer having no PTC characteristic as illustrated in the solid line (B). This eliminates the possibility that the copying paper $P_2$ adheres to a local high-temperature portion or portions of the heat generating roller (74).

Further, according to this embodiment, a large amount of current flows in the portion of the resistance heater layer (110) of the roller (74) with which the copying paper $P_1$ or $P_2$ is contacted, that is, the portion of that heater layer (110) which is deprived of its heat by contacting with the copying paper $P_1$ or $P_2$ to decrease in temperature, while only a usual small amount of current passes through the remaining portion of said layer (110). This serves to save the power which is to be consumed by the toner fixing device.

Further, according to this embodiment, there is no need to previously set the surface temperature of the heat generating roller (74) at a level which is estimated to be higher than normal on the assumption that surface temperature is expected to become lower due to the contact of the copying paper $P_1$ or $P_2$ with the layer (110) of the roller (74). Accordingly, the adherence of the copying paper $P_1$ or $P_2$ to the layer (110) can be prevented which is attributable to the contact of the tip end portion alone of the copying paper $P_1$ or $P_2$ with the higher temperature roller (74).

Further, according to this embodiment, since as shown in FIG. 14 the heat insulating layer (151) is provided for the core body (148) of the paired roller (76), the heat from the roller (74) is prevented from escaping into that paired roller (76).

Reference will now be made to the methods of forming the resistance heater layer in connection with the accompanying drawings.

Figure 17:
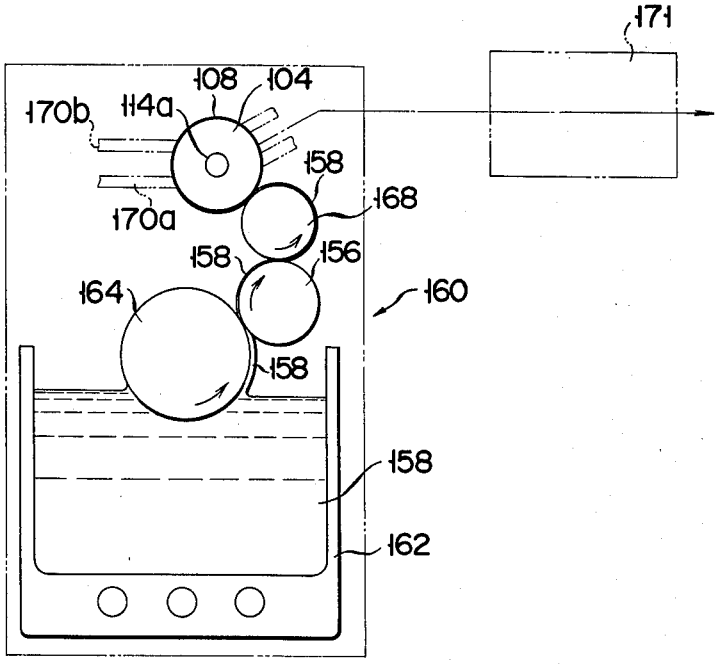
FIG. 17 schematically shows one construction of a coating device for a resistance heater according to one embodiment of the invention.

First, an electric resistance composition consisting of said polyamide resin, carbon black and graphite is kneaded together with dimethyl formamide as the solvent to prepare a liquid base material (158) for the resistance heater layer. This resistance heater layer base material (158) is coated, by a coating device (160) shown in FIG. 17, onto the electrically insulating layer (108) of the roller body (102). The coating device (160) has a receptacle (162) in which is received the liquid resistance heater layer base material (158). A feed roller (164) is disposed within the receptacle (162) in such a manner as to permit a part thereof to be immersed in the said liquid base material (158) received in the receptacle (162). With the feed roller (164) is contacted an intermediate roller (166), with which is contacted a coating roller (168), with which is contacted the core body (104) of the roller (74) having the insulating layer (108) formed on its outer peripheral surface. By having the feed roller (164) allowed to rotate at a speed of about 240 r.p.m., the liquid base material (158) is coated, in the form of a film, onto the electrically insulating layer (108) via the intermediate roller (166) and then via the coating roller (168).

The shaft portions (114*a*), (114*b*), at both ends, of the core body (104) are each arranged to be guided by a pair of upper and lower guide rails (170*a*), (170*b*). The core body (104), while it is driven to rotate by means of a rotating/moving mechanism (not shown), is guided and moved by the upper and lower guide rails (170*a*), (170*b*). The core body (104), when it is guided and moved up to a position at which it contacts the coating roller (168), makes at that position a specified number of rotations while it is placed under such rolling contact.

The core body (104) which has above been coated with the resistance heater base material (158) is then guided by the guide rails (170*a*), (170*b*) and, while it is kept under rotation, is fed into a dryer device (171).

Figure 18:
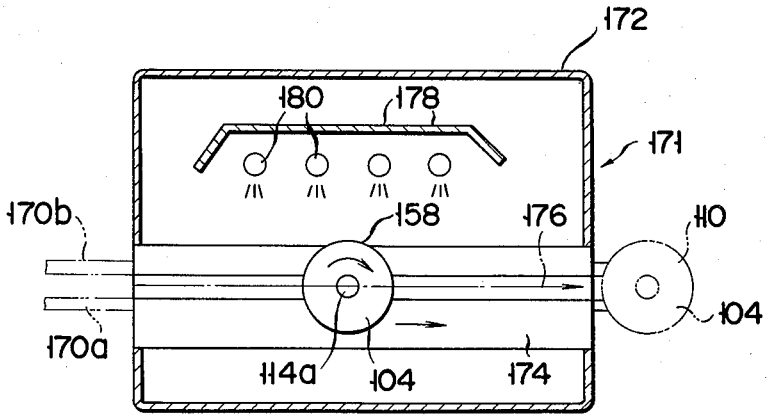
FIG. 18 schematically shows the construction of a drying device used for the coating device shown in FIG. 17.

The dryer device (171), as shown in FIG. 18, comprises a heating chamber (172), a conveyor (174) provided passing through the heating chamber (172) and an infrared rays heater (180) which is disposed above a core body moving path (176) formed by the conveyor (174) and which has its rear portion surrounded by a reflecting plate (178). The core body (104) coated with the resistance heater layer base material (158), while it is kept in rotation, is allowed to pass through the heating chamber (172) of the dryer device (170). Thus is formed a resistance heater layer (110). In this embodiment, the heating temperature is set at 400° C. while the heating period set at two hours.

The above embodiment has referred to the construction of the coating device (160) wherein are provided the feed roller (164), intermediate roller (166) and coating roller (168). The invention, however, is not limited to such construction but may use the feed roller (164) concurrently as the coating roller (168).

Figure 19:
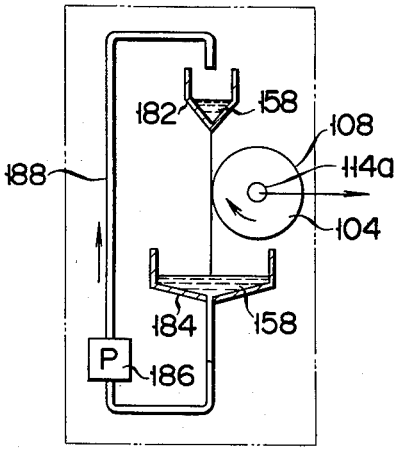
FIG. 19 schematically shows another construction of the coating device according to one embodiment of the invention.

Further, the coating device may be constructed as shown in, for example, FIG. 19. Namely, the base material (158) for resistance heater layer is received in an upper receptacle (182) and, from a narrow slit provided in the bottom of the receptacle (182), the base material (158) is allowed to drop in the form of a film. Then, the core metal body (104) formed with the insulating layer (108), while it is kept in rotation, is contacted with the filmy resistance heater layer base material (158), whereby the base material (158) is coated over the outer peripheral surface of the core body (104).

Note here that in the above-mentioned case the superfluous base material (158) which has fallen off without being coated on the core body (104) is received into a lower receptacle (184). The base material (158) which has been received in the lower receptacle (184) is again sent into the upper receptacle (182) via a circulating pipe path (188) equipped with a pump (186).

In the above-mentioned two methods of forming the resistance heater layer, the compounds Nos. 1 to 9 listed in Table 2 were selectively used as the conductive material and well serve the purpose.

Figure 20:
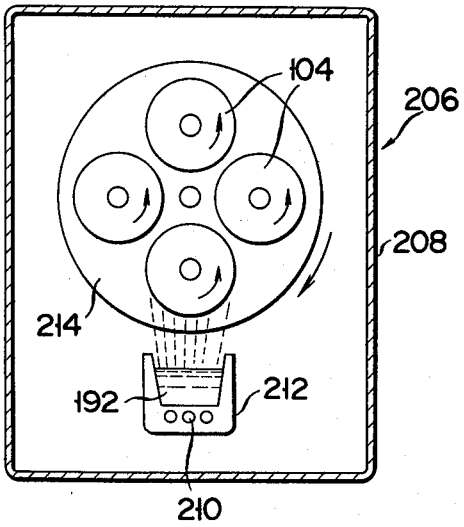
FIG. 20 schematically shows the construction of a vacuum deposition device for the resistance heater.

Further, where one of the compounds Nos. 11 to 24 in Table 2 is selectively used as the conductive material, a vacuum deposition device (206) shown in FIG. 20 may be used for the said resistance heater layer forming method. The vacuum deposition device (206) has within its highly vacuumized sealed receptacle (208) a heating tub (212) equipped with a heater (210). The metal (192) within the heating tub (212) such as nickel chrome, tantalum or platinum is heated and gasified. Simultaneously, the core bodies (104) attached to a rotary fitting board (214) are each allowed to rotate about its axis and concurrently are allowed respectively to turn around the center of the rotary fitting board (214). Thereafter, the metal steam which has been produced by heating is deposited onto the core metal body (104) which is received within the seating receptacle (208) and which has a non-metallic insulating layer (108) previously formed on its outer peripheral surface. Thus is formed a resistance heater layer (110).

Figure 21:
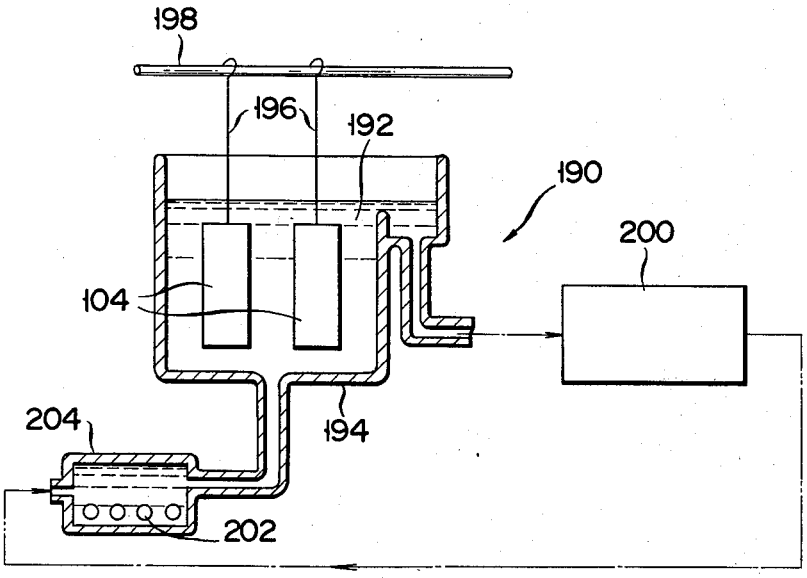
FIG. 21 schematically shows the construction of an electroless plating device for the resistance heater.

The resistance heater layer forming method wherein the conductive material is constituted by metal is not limited to the use of the above-mentioned vacuum deposition device (206). For instance, use may be made of such an electroless plating device (194) as shown in FIG. 21. The electroless plating device (190) has a plating tub (194) in which is received a mass of electroless plating solution (192). The core metal body (104) formed on its outer peripheral surface with the non-metallic insulation layer (108), after it is subjected to activating treatment, is immersed in the electroless plating solution (192) by being suspended from a suspension rod (198) via a suspension metal fitting. The electroless plating solution (192) which has overflowed the plating tub (194) is sent into a readjusting section (200). Further, the electroless plating solution (192) thus sent into the readjusting section (200) is further sent into a heating tub (204) equipped with a heater (202) and is heated thereby and is then sent back into the plating tub (194) and is thus made ready for reuse. Where the electroless plating solution (192) consists mainly of, for example, nickel, it is kept, within the plating tub (194), at a temperature of 40° C. to 60° C. and, when under such condition the electroless plating solution is immersed for a period of 30 minutes, the resistance heater layer (110) is formed, on the outer circumferential surface of the core metal body (104), with a layer thickness of about 10 μm.

What we claim is:

1. A fixing device for an electronic duplicator machine for heating toner attracted to copying paper and for fixing the toner onto the copying paper, said fixing device comprising:

a rotatable heat generating roller which includes:

(a) a hollow cylindrical body journally supported at each end for rotation about its elongated axis;

(b) a heat insulating layer formed on the outer circumferential surface of said hollow cylindrical body for preventing heat transmission to said hollow cylindrical body;

(c) a heat generating layer covering said heat insulating layer and including an electrically resistive layer through which electric current flows to generate heat and an electrically insulating layer disposed between said electrically resistive and said heat insulating layers, and (d) conducting means including a first group of conducting members circumferentially disposed at regular intervals on one end portion of said electrically resistive layer and a second group of conducting members circumferentially disposed at regular intervals on the other end portion of said electrically resistive layer;

power supply means including a first terminal and a second terminal each having a fixed position relative to said rotatable heat generating roller and being connected to a power source, said first and second terminals respectively contacting a predetermined number of said conducting members of said first group and a predetermined number of said conducting members of said second group as said heat generating roller rotates relative thereto so as to preferentially heat that portion of the electrically resistive layer which lies between said predetermined number of conducting members of said first group in contact with said first terminal and said predetermined number of conducting members of said second group in contact with said second terminal; and a supporting roller disposed parallel to said heat generating roller to support the copying paper in a contacting relationship with said heat generating roller, said supporting roller including a nip area in contact with said preferentially heated portion of said electrically resistive layer.

2. A fixing device according to claim 1, wherein each of said terminals is in sliding contact with a corresponding one of said groups of said conductive members in a manner that it covers substantially $\frac{1}{3}$ of the entire circumference of said heat generating roller.

3. A fixing device according to claim 2, wherein said resistive layer has conductive metal.

4. A fixing device according to claim 2, wherein said resistive layer has a conductive alloy of metal.

5. A fixing device according to claim 3 or 4, wherein said resistive layer is a plated layer.

6. A fixing device according to claim 5, wherein said resistive layer has a uniform thickness ranging from 0.1 μm to 100 μm.

7. A fixing device according to claim 3 or 4, wherein said resistive layer is a deposited layer.

8. A fixing device according to claim 7, wherein said resistive layer has a uniform thickness ranging from 0.1 μm to 100 μm.

* * * * *